United States Patent [19]

Westlake, Jr.

[11] 4,241,501

[45] Dec. 30, 1980

[54] ONE-PIECE PLASTIC SAFETY RAZOR

[76] Inventor: Edward B. Westlake, Jr., 307 Lincoln Ave., Havertown, Pa. 19083

[21] Appl. No.: 6,593

[22] Filed: Jan. 26, 1979

[51] Int. Cl.[3] ..... B26B 21/32

[52] U.S. Cl. ..... 30/59

[58] Field of Search ..... 30/58, 59, 60, 61, 84, 30/330, 331, 339; 24/213 R, 213 B, 214, 217 R

[56] References Cited

U.S. PATENT DOCUMENTS

| | | | |
|---|---|---|---|
| 933,571 | 9/1909 | Molkenthm | 30/59 |
| 1,201,231 | 10/1916 | Apstein | 30/331 |
| 3,154,852 | 11/1964 | Westlake | 30/59 X |
| 3,259,978 | 7/1966 | Weichselbaum | 30/59 |
| 3,734,551 | 5/1973 | Hughes | 24/217 X |

*Primary Examiner*—Gary L. Smith

*Attorney, Agent, or Firm*—Max R. Millman

[57] ABSTRACT

A one-piece plastic razor molded to contain a handle, a guard plate at the top thereof, at least one locating pin upstanding from the guard plate and adapted to extend through a slot in the razor blade, a cover hinged at one end of the guard plate having at least one slot, beads in the locating pin to frictionally engage the cover slot and firmly lock the cover against the blade on the guard plate and means to ease opening of the cover to replace the blade without sacrificing the locking action of the cover on the guard plate.

6 Claims, 6 Drawing Figures

ONE-PIECE PLASTIC SAFETY RAZOR

This invention pertains to a one-piece plastic safety razor and constitutes an improvement over my U.S. Pat. No. 3,154,852.

Plastic safety razors are at this point in time quite popular becuase they are relatively inexpensive and designed to be disposable after a single shave.

My patented razor provides a one-piece plastic razor which allows the user the option of disposing the same after a single shave or of changing blades and continuing to use the razor thereafter and still benefit economically because the razor itself is so constructed that it can be manufactured in large quantities with relatively inexpensive plastics and by inexpensive injection molding techniques. Therefore, the razor can still be sold at a relatively low unit price. Thus, a permanent razor is provided at a disposable price especially adapted for use in hospitals, hotels, homes, vending machines and the like.

The safety razor of my U.S. Pat. No. 3,154,852 is molded to contain a hollow handle, a guard plate at the top thereof, a cover hinged to one end of the guard plate, one or more locating pins upstanding from the guard plate adapted to extend through one or more slots in the razor itself and one or more slots in the cover, and beads extending laterally from the locating pins to firmly lock the cover and blade in place on the guard plate so that the blade will be properly and firmly held in the razor head for a comfortable shave. To assist in lifting the cover to change blades, a tab is provided at the free end of the cover. I have found that to obtain firm locking of the cover against the blade and on the guard plate, lifting of the cover using the tab becomes difficult.

The primary object of my invention is to provide a means in my patented safety razor to ease the opening of the cover to change blades while maintaining the firm locking action of the cover against the blade and the guard plate.

Another object of the invention is to provide a razor of the character described in which the means to ease the opening of the cover but firmly lock the cover on the guard plate is relatively simple and does not increase the expense of manufacturing the razor and the price of the razor.

These and other objects of the invention will become more apparent as the description proceeds in conjunction with the accompanying drawing wherein.

Specific reference is now made to drawings in which similar reference characters are used for corresponding elements throughout.

Figure 2:
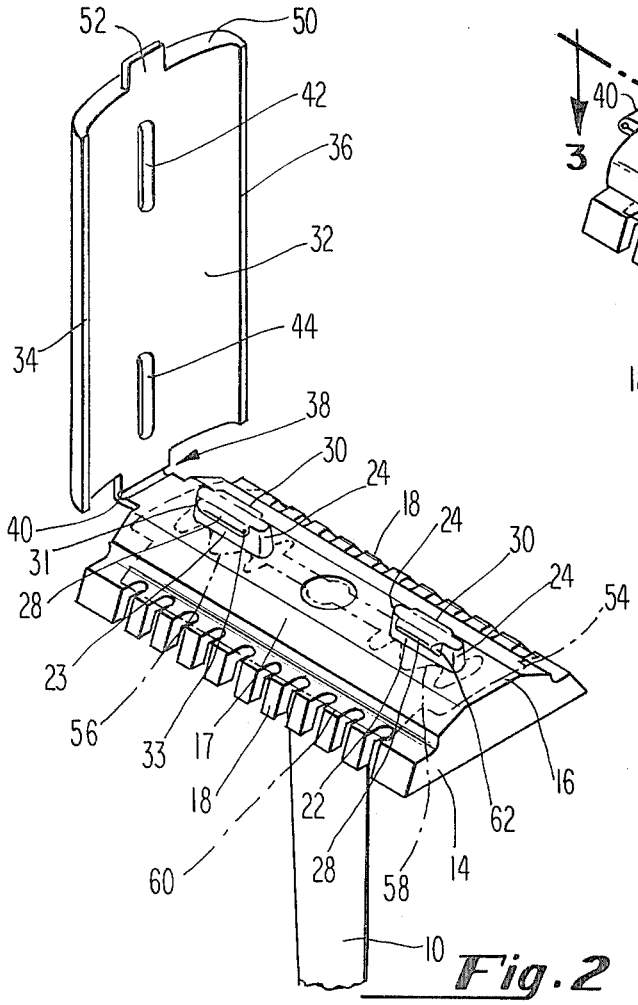
FIG. 2 is a fragmentary perspective view of the razor with the cover open and blade shown in phantom.

The razor is molded in one piece from many different plastics but polypropylene is preferred for a reason stated later. The razor may be natural or colored and contains a downwardly tapered hollow handle 10 and an integral head 12. The latter includes a longitudinal guard plate 14 centrally attached to the handle having a median portion 16 and longitudinal edge portions 18. In the modifications of FIGS. 1–6, these end edges are serrated whereas in FIG. 7 they are continuous as at 20. The median portion 16 of the guard plate includes downwardly angled longitudinal portions 17 leading to the edge portions 18 or 20 thereby providing an overall lateral curvature to the guard plate.

Spaced longitudinally and upstanding from the median portion 16 of the guard plate 14 are front and rear locating pins 22 and 23 which are preferably shaped as rectangular members having their lower longitudinal edges extending along the longitudinal center of the median portion 16. Each locating pin has front and rear curved vertically extending end walls 24 and 26. Extending laterally from the upper edges of each pin are rounded beads 28 and 30 which extend along the major length of the pin but which terminate longitudinally inwardly of the end walls 24 and 26 of each pin. The beads 28 and 30 have vertically extending front and rear end walls 31 and 33 which are substantially perpendicular to the main plain of the locating pin. The overall height of the locating pin is about 3/16 in.

A cover 32 is provided which is slightly arcuate, is substantially as long as the guard plate and as wide as the median portion 16 thereof and includes longitudinal free edges 34 and 36. The cover is about 1/16 in. thick.

As indicated in my U.S. Pat. No. 3,154,852, the cover is hinged at its rear end to the rear end of the guard plate in a special manner. A strip 38 interconnects the adjacent rear ends of the cover and guard plate, said strip including a middle or web portion 40 which is thinner than the remaining thickness of the strip 38 and sufficiently flexible to provide a hinge pivot for the cover 32 and the guard plate 14, the web portion 40 being the only flexible part of the hinge. Polypropylene is the preferred plastic because hinge strips on the order of magnitude of ten-thousandth of an inch thick can be flexed a million or more times without failure or fatigue.

Figure 1:
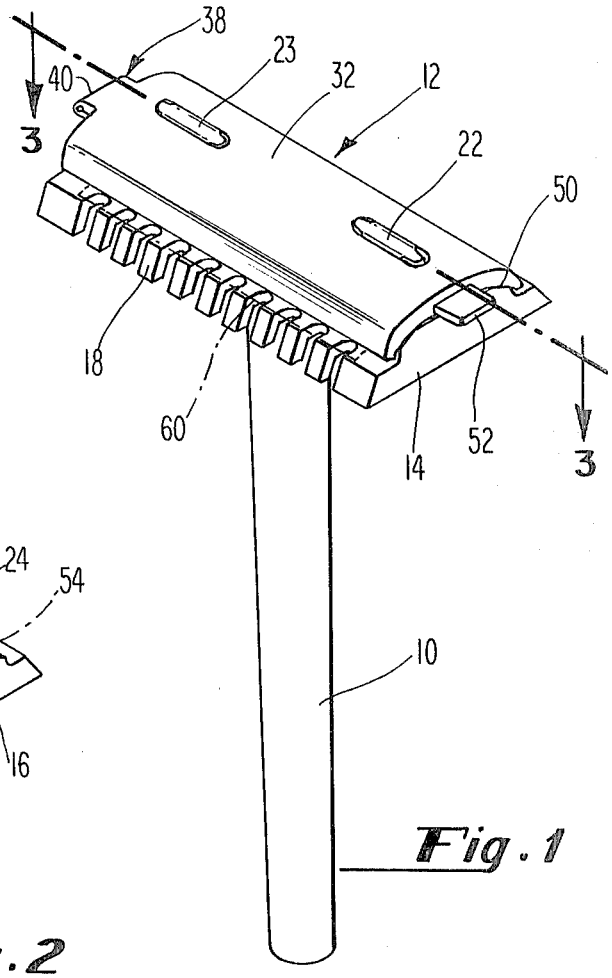
FIG. 1 is a full view of the razor with the cover closed and blade shown in phantom.
Figure 3:
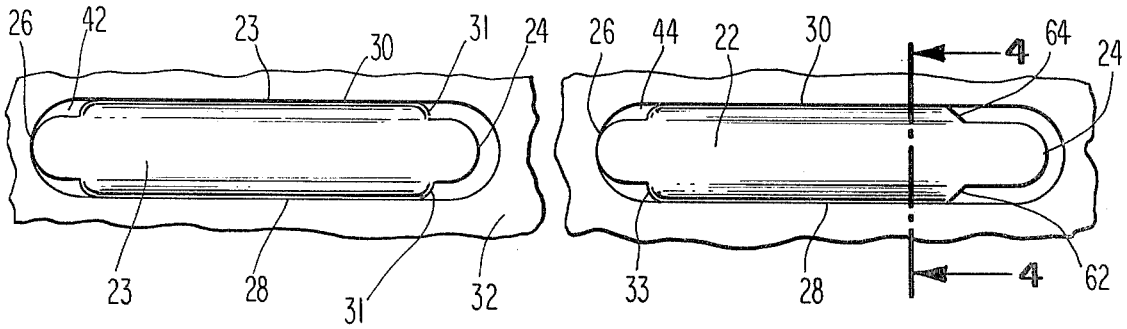
FIG. 3 is a longitudinal view looking down on the razor head from the line 3—3 of FIG. 1.
Figure 4:
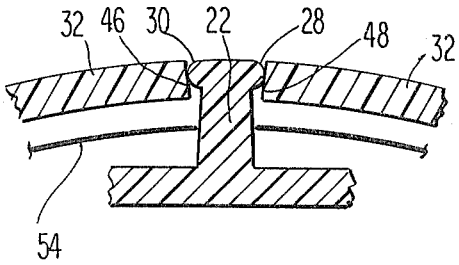
FIG. 4 is a transverse sectional view of the razor head taken on the line 4—4 of FIG. 3 with a blade shown locked in place.
Figure 5:
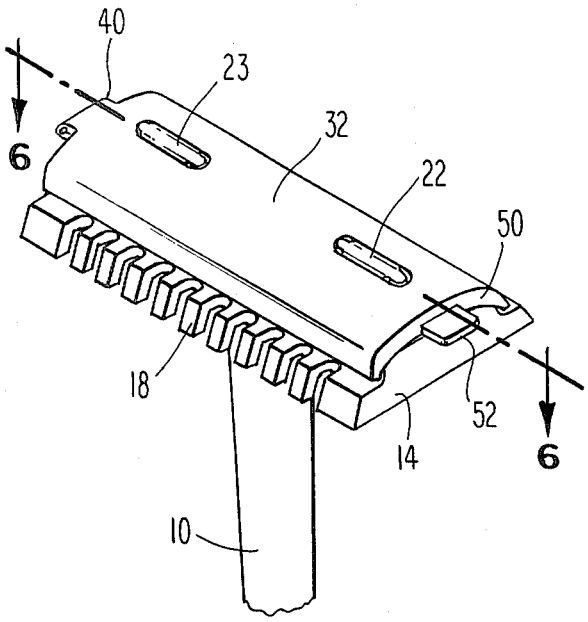
FIG. 5 is a view similar to FIG. 1 of a modified form of razor but without a blade therein.
Figure 7:
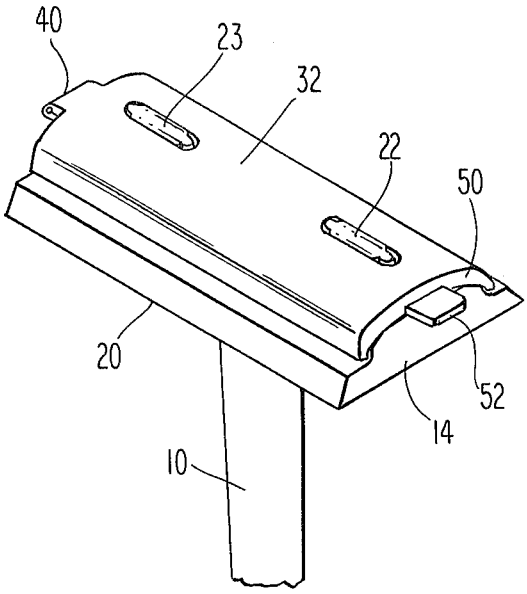
FIG. 7 is a fragmentary perspective view of yet another modification of the razor without a blade therein.

The cover 32 includes elongated slots 42 and 44 in longitudinal alignment with and spaced to receive the locating pins 30 when the cover is closed upon the guard plate, the slots being slightly longer than each locating pin 30. Each slot is downwardly tapered so that the longitudinal side walls 46 and 48, see FIG. 3, converge downwardly, the maximum width of the slot being slightly less than the width of the locating pins across the laterally extending beads 28 and 30 thereof. The free edge 50 of the cover contains a central lifting tab 52 which when the cover is in the closed position, as shown in FIGS. 1, 5 and 7, extends beyond the corresponding edge of the guard plate 14.

A double-edge blade 54 is formed conventionally with a central longitudinal opening having two portions 56 and 58. The dimensions of the locating pins 22 and 23 approximate these open portions 56 and 58. With the cover open, as seen in FIG. 2, the blade is placed on the median portion 16 of the guard plate with the locating pins 22 and 23 extending through the blade openings 56 and 58. The cover is then pushed down until the locating pins enter the slots 42 and 44. In so doing, the beads 28 and 30 first engage the narrower lower portions of the cover slots 42 and 44 spreading the slots slightly.

Continued downward movement of the cover causes the pins 22 and 23 to enter the cover slots 42 and 44 fully with the beads 28 and 30 pressing tightly against and frictionally the engaging tapered walls 46 and 48 of the cover slots thereby locking the cover on the guard plate, curving the blade and firmly wedging it between the guard plate and the cover and locking it in position for a proper shave with the blade edge 60 exposed above the serrated or continuous edge 18 or 20 of the guard plate.

Because of the necessity of a very tight fit between the beads 28 and 30 of the locating pins 22 and 23 and the tapered walls 46 and 48 of the cover slots 42 and 44 to lockingly retain the razor virtually immovably in place in the razor head, it is often difficult to raise the cover by means of the lifting tab 52 to change blades. To ease this lifting and opening of the cover, the front walls 31 of the beads 28 and 30 of the front locating pin 22 only are cut off at an angle of 30°–60°, preferably 45°, thereby providing downwardly and rearwardly recessed surfaces 62 and 64. When the cover is now lifted by means of the tab 52, the tapered recessed surfaces 62 and 64 begin to ease the front slot 42 beyond the beads at the front locating pin 22. The rest of the lifting and opening action of the cover is then readily completed without sacrificing the locking action required when the cover is in its closed position.

Figure 6:
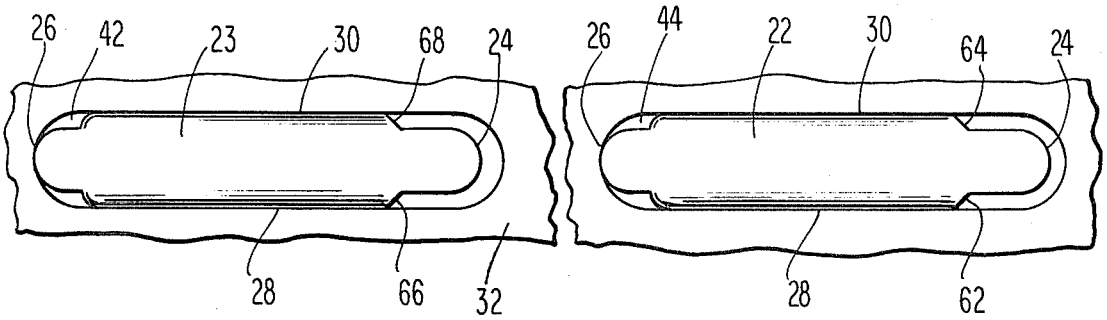
FIG. 6 is a view looking down on the razor head taken from the line 6—6 of FIG. 5.

In the modification shown in FIGS. 5 and 6, the front walls 31 of the beads 28 and 30 on the rear locating pin 23 are also cut off at an angle of 30°–60°, preferably 45°, to provide downwardly and rearwardly tapered recessed surfaces 66 and 68 similar to the tapered surfaces 62 and 64 on the beads of the front locating pin 22. While the ease of opening of the cover using the finger tab can readily be effected using the tapered surfaces on the beads of only the front locating pin 22, such tapered surfaces can also be provided on the beads of the rear locating pin 23 as well.

While preferred embodiments of the invention have been shown as described, variations may be made by those skilled in the art without departing from the spirit of the invention.

I claim:

1. A plastic safety razor comprising a handle, a guard plate mounted thereon including at least one upstanding elongated locating pin adapted to extend through an opening in a razor blade, said pin including longitudinal beads extending laterally from said pin, a cover substantially coextensive with said guard plate and hinged at the rear end to said guard plate, at least one slot in said cover adapted to receive said locating pin and frictionally engage said locating pin beads when the cover is closed on the guard plate with a razor blade wedged between said cover and guard plate to lock the blade in place, and means on said locating pin to ease the lifting of said cover from the closed to the open position of the razor for replacement of the blade wherein each bead on said locating pin includes a front end wall remote from the hinged rear end of the razor, said front end walls of said beads extending substantially perpendicular to the main plane of said locating pin, said front end walls of said beads being cut off at a downwardly and rearwardly extending taper and constituting the means to ease the lifting of said cover from the closed to the open position of the razor.

2. The razor of claim 1 wherein the angle of the taper of said cut off portions of said front end walls of said beads is between 30° and 60°.

3. The razor of claim 1 wherein said slot of said cover is downwardly tapered to provide a firmer locking action of said locating pin in said cover slot.

4. The razor of claim 1 wherein said guard plate includes two upstanding elongated locating pins each with said laterally extending beads, one being a rear locating and the other a front locating pin, said means to ease the lifting of said cover from the closed to the open position being associated with said front locating pin only.

5. The razor of claim 4 wherein each bead on said front locating pin includes a front end wall remote from the hinged rear end of the razor, said front end walls of said beads extending substantially perpendicular to the main plane of said locating pin, said front end walls of said beads being cut off at a downwardly and rearwardly extending taper and constituting the means to ease the lifting of said cover from the closed to the open position of the razor.

6. The razor of claim 5 wherein each bead of said rear locating pin includes a front wall remote from the hinged rear end of the razor, said front end walls of said rear locating pin beads extending substantially perpendicular to the main plane of said rear locating pin, said front end walls of said beads of said rear locating pin being cut off at a downwardly and rearwardly extending taper.

* * * * *